US005561502A

United States Patent [19]

Hirai et al.

[11] Patent Number: 5,561,502

[45] Date of Patent: Oct. 1, 1996

[54] IMAGE FORMING APPARATUS

[75] Inventors: Masahide Hirai, Yokohama; Takashi Shibuya, Kawasaki, both of Japan

[73] Assignee: Canon Kabushiki Kaisha, Tokyo, Japan

[21] Appl. No.: 411,333

[22] Filed: Mar. 27, 1995

[30] Foreign Application Priority Data

Mar. 26, 1994 [JP] Japan ..... 6-079766

[51] Int. Cl.[6] ..... G03G 15/02

[52] U.S. Cl. ..... 355/208; 355/219

[58] Field of Search ..... 355/219, 208; 361/221, 235

[56] References Cited

U.S. PATENT DOCUMENTS

| | | | |
|---|---|---|---|
| 4,851,960 | 8/1989 | Nakamura et al. | 361/225 |
| 5,003,350 | 3/1991 | Yui et al. | 355/208 X |
| 5,144,368 | 9/1992 | Ohzeki et al. | 355/219 |
| 5,305,177 | 4/1994 | Aoki et al. | 355/219 X |
| 5,323,215 | 6/1994 | Ohtaka et al. | 355/219 X |

FOREIGN PATENT DOCUMENTS

| | | |
|---|---|---|
| 56-91253 | 7/1981 | Japan . |
| 60-83049 | 5/1985 | Japan . |
| 60-147756 | 8/1985 | Japan . |
| 62-291676 | 12/1987 | Japan . |

*Primary Examiner*—Nestor R. Ramirez

*Attorney, Agent, or Firm*—Fitzpatrick, Cella, Harper & Scinto

[57] ABSTRACT

An image forming apparatus which includes a member to be charged, and a charging member, contactable to the member to be charged and being supplied with a voltage, for charging the member to be charged, wherein the voltage applied to the charging member for image formation contains an oscillation component, wherein a peak-to-peak voltage of the oscillation component in a first period for formation of a predetermined number of initial images is higher than in a second period after the predetermined number of image formations.

43 Claims, 2 Drawing Sheets

IMAGE FORMING APPARATUS

FIELD OF THE INVENTION AND RELATED ART

The present invention relates to an image forming apparatus in which a charging member supplied with a voltage is contacted to a member to be charged to electrically charge it.

In an image forming apparatus such as an electrophotographic copying machine or electrostatic recording machine, corona dischargers are widely used as a means for charging or discharging a member to be charged such as a photosensitive member, dielectric member (image bearing mender), a transfer material or the like. However, it involves problems that a high voltage is required, ozone is produced, and cleaning means for a corona wire is required.

On the contrary, a contact type charging device for charging the member by contacting a charging member supplied with a voltage to the member to be charged is advantageous in that, the voltage level of the voltage source can be reduced, that the amount of ozone production is small, or the like. For this reason, it is recently taking place of the corona charger as the charging means (Laid-Open Japanese Patent Applications Nos. 91253/1981, 194349/1981, 147756/1985 and so on).

When the electric discharge occurs in the gap between the charging member and the member to be charged in the contact type charging device, a DC voltage higher than a charge starting voltage may be applied to the charging member to produce discharge so as to electrically charge the member to be charged (DC type).

In another type, an AC voltage is used biased with a DC voltage Corresponding to a target charge potential, by which the charging is made more uniform (AC type). More particularly, as disclosed in U.S. Pat. No. 4,851,960, the alternating voltage component may have a peak-to-peak voltage not less than twice as high as the charge starting voltage when only a DC voltage is applied to the charging member, by which the charge potential is made further uniform.

As one of the problems of the contact charging device used with an image forming apparatus, there is improper charging and resultant improper image attributable to contaminate on of the charging member.

In a reverse developing system, for example, when the main switch is actuated after a substantial period of off-state, an image defect (black stripe) occurs under high temperature and high humidity conditions. Since the charging blade (charging member) is always kept in contact with the surface of the photosensitive member, the residual toner deposited on the surface of the photosensitive member during the image forming process, is not sufficiently removed by the cleaning member, but remains on the charging blade. This is the cause of the black stripe under the high temperature and high humidity conditions. In addition to the residual toner, or the like remains. These foreign matters are accumulated between the charging blade and the surface of the photosensitive member with continuation of the image forming process operation.

The problem does not occur when the image forming processes are continuously carried out. However, when the image forming operation is completed under high temperature and high humidity condition, and left as it is for 6–8 hours, the stripe-like non-uniformity of charging occurs between the foreign matter having portion and the portion not having it, because the electric resistance of the foreign matter lowers because it absorbs the moisture and because the foreign matter is attracted on the charging blade. The non-uniform charging occurs immediately after the main switch is actuated again. More particularly, the insufficiently charged portion appears as a black stripe extending in a direction perpendicular to the longitudinal direction of the charging member.

In the case of the charging roller, periodical non-uniformity may occur due to the matters deposited on the roller, as the case may be.

SUMMARY OF THE INVENTION

Accordingly, it is a principal object of the present invention to provide an image forming apparatus in which stripe-like charge non-uniformity is effectively prevented.

It is another object of the present invention to provide an image forming apparatus in which improper charging due to deposition of the foreign matter to the charging member is avoided.

It is a further object of the present invention to provide an image forming apparatus in which image defects in the form of stripe-like non-uniformity under high temperature and high humidity conditions, can be avoided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

EMBODIMENT 1

(1) An Exemplary Image Forming Apparatus

Figure 1:
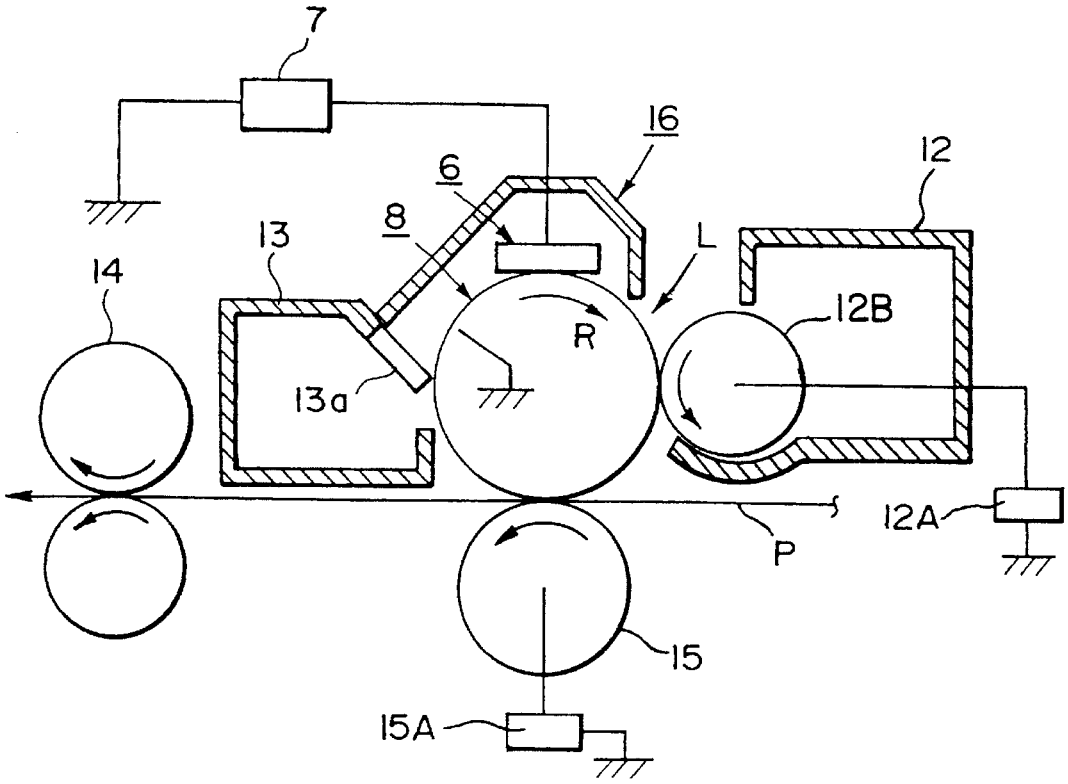
FIG. 1 is a sectional side view of an image forming apparatus according to an embodiment of the present invention.
Figure 2:
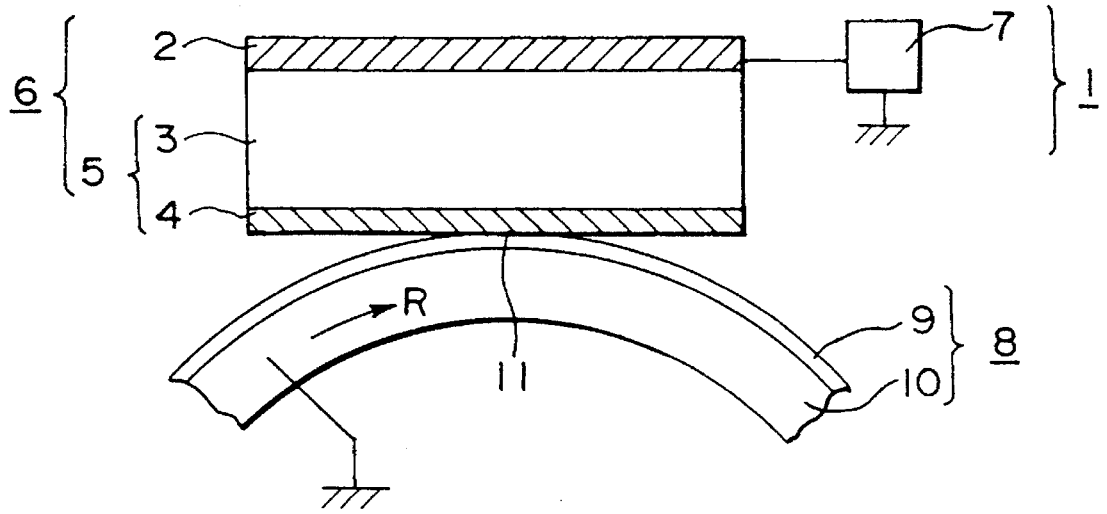
FIG. 2 is an enlarged sectional view of a charging blade.

FIG. 1 schematically shows an example of an image forming apparatus using a contact charging device. In this example, the image forming apparatus is a laser beam printer of an image transfer type and electrophotographic type. FIG. 2 is an enlarged view of the charging member.

An image bearing member 8 is in the form of an electrophotographic photosensitive drum, is rotated at a predetermined process speed (peripheral speed) in the clockwise direction R indicated by an arrow.

A fixed contact charging member 6 is in the form of a charging blade press-contacted to the photosensitive drum 8 at a predetermined pressure. The charging blade 6 is supplied with a predetermined charging bias from a bias voltage source 7, so that the surface of the photosensitive drum 8 is charged (primary charging) to a predetermined polarity and potential through contact charging process. A contact type blade charging device 1 is constituted by the blade 8 and the voltage source 7.

The surface of the rotating photosensitive drum 8 thus charged is exposed to scanning laser beam (L) modulated in accordance with time series electric digital pixel signal corresponding to an intended image, supplied from an unshown laser scanner, by which an electrostatic latent image is formed on the photosensitive drum 8, corresponding to the intended image.

Subsequently, the electrostatic latent image is visualized into a toner image through reverse-development by a developing device 12. The toner image is transferred onto a transfer material P supplied at a predetermined timing from unshown sheet feeding station to an image transfer position where a nip is formed between the photosensitive drum 8 and a transfer roller 15. Designated by references 12A, 15A are voltage sources for transferring developing bias voltage and image transfer bias voltage to a developing sleeve 12B of the developing device 12 and the transfer roller 15.

The transfer material P having received the toner image at the image transfer position, is separated from the photosensitive drum 8 and introduced into an image fixing device 14, where the toner image is heated and fixed.

The surface of the photosensitive drum 1, after the image transfer onto the transfer material is cleaned by a cleaning blade 13a of a cleaner 13, so that the residual matters such as residual toner is removed, so as to be used for the image formation repeatedly.

In this embodiment, the image forming apparatus is usable with a detachably mountable process cartridge, which contains the photosensitive drum 8, the charging blade 6, the developing device and the cleaner 13. The process cartridge 16 is mounted in place in the main assembly of the image forming apparatus, so that the driving system and electric system are connected therebetween.

In this embodiment, the photosensitive drum 8 comprises a drum base 10 and OPC, amorphous silicon, selenium, zinc oxide or another photosensitive layer 9 as a surface layer.

The charging blade 6, as shown in FIG. 2, comprises an electroconductive base (electric power supplying member) in the form of a metal plate electrode 2, and a resistance layer 5 integral therewith and electrically connected therewith. The charging blade 6 comprises a resistance layer 5 having a first resistance layer 4 contactable to the photosensitive drum 8 and a second resistance layer 3 interposed between the first resistance layer 4 and the metal electrode 2.

The second resistance layer 3 comprises a urethane sponge material having a thickness of approx. 4 mm in which potassium titanate whiskers (DENTOL, available from Otsuka Kagaku Kabushiki Kaisha) are dispersed for the purpose of providing electroconductivity with controlled resistance, for example. It is bonded to the electrode metal 2 by electroconductive adhesive material.

The first resistance layer 4 is in the form of PVdF sheet having a thickness of approx. 100 μm in which the potassium titanate whiskers are dispersed. It is bonded to the side of the second resistance layer 3 remote from the metal electrode 2.

In order to assure stable and uniform charging performance, the first resistance layer 4 and the second resistance layer 3 preferably have the resistances $10^7$–$10^9$ ohm/cm$^2$, $10^5$–$10^6$ ohm/cm$^2$ approximately, respectively, and the resistance of the first resistance layer 4 is always higher than that of the second resistance layer 3.

The charging blade 6 is fixed on an unshown support, while the first resistance layer 4 is press-contacted to the photosensitive drum 8 at a predetermined pressure. To the electrode metal plate 2 of the charging blade 6, a charging bias voltage is applied from a voltage source, so that the portion of the photosensitive drum surface at the nip 11 between the charging member 6 and the photosensitive drum 8 is electrically charged. The surface of the photosensitive drum 8 in the nip 11 is renewed with the rotation of the drum 8, so that the entirety of the photosensitive layer 9 is charged.

The image bearing member 8 is not limited to a drum, but may be a belt or sheet.

(2) Control of the Voltage Applied to the Charging Blade 6

In an example of this embodiment, the photosensitive drum 8 having a negative charging polarity is rotated at a process speed of 48 mm/sec, and the charging blade 6 is supplied with a DC voltage component of −650 V and an AC voltage component having a frequency of 200 Hz and a peak-to-peak voltage of 2.0 kVpp. The charging blade 6 is press-contacted to the surface of the photosensitive drum at 600 g.

The sum of such a DC voltage and such an AC voltage is a normal charging bias voltage during the image forming operation.

Durability test operations were carried out under high temperature and high humidity condition, i.e., 32.5 ° C. and 85% of humidity. On a first day, 2000 continuous image forming operations were carried out, and then the main switch of the image forming apparatus was the deactuated. On the next day, the main switch is actuated, and the image forming operation was carried out.

Table 1 shows the effects of the AC voltage and the image quality evaluation, in the image forming operations immediately after the main switch is thus actuated.

TABLE 1

| AC voltage (kVpp) | Image quality evaluation |
|---|---|
| 2.0 | NG |
| 2.2 | F |
| 2.4 | G |
| 2.6 | G |

NG: no good
F: practically usable
G: satisfactory (The evaluation marks are the same in the Tables hereinafter.)

As will be understood from this Table, by using an AC voltage of 2.2–2.4 kVpp, satisfactory images without the black stripe can be produced.

With increase of the number of image forming operations, the good images can be provided with a lower AC voltage (lower than 2.2–2.4 kVpp).

The reason is considered as follows.

With the repeated image forming operations involving electric discharge actions between the charging blade 6 and the photosensitive drum 8, the resistance reduction due to the moisture absorption of the material deposited on the charging blade 6, is increased to the normal level gradually.

Up to a predetermined number of image forming operations after the actuation of the main switch, an AC voltage which is 1.1–1.2 times the normal level, is applied, and after a predetermined number of image forming operations are carried out, the normal set voltage is enough to provide satisfactory images. Table 2 shows the predetermined numbers, and the image evaluation.

TABLE 2

| Number (sheet) | Evaluation |
|---|---|
| 2 | F |
| 4 | G |
| 6 | G |

As will be understood from Table 2, for initial 3–4 transfer materials after actuation of the main switch, the alternating voltage which is 1.1–1.2 times, preferably not less than 1.2 times, is applied to the charging member, by which satisfactory images are produced. Thereafter, the voltage is restored to the normal level, without the result of black stripes.

The charging member has a resistance level which is different if the material is different, the optimum voltage to be applied to the charging member (normal voltage) is also different. Immediately after the actuation of the main switch, 1.1–1.2 times of the bias voltage is preferably. As shown in Table 2, after initial several to several tens image forming operations, the applied voltage to the charging member is lowered, by which deterioration of the photosensitive member due to the charging can be avoided, with the image quality maintained.

EMBODIMENT 2

In Embodiment 1, the period in which the applied voltage to the charging member is higher than the normal level, is from the actuation of the main switch to the predetermined number of image forming operations performed. In Embodiment 2, end of the period is determined as a predetermined time period after start of the voltage application to the charging member after actuation of the main switch.

The voltage applied to the charging member in this embodiment is higher in the period from the start of the voltage application to the charging member to elapse of the predetermined time than in the period after the elapse of the predetermined time.

When the image forming operation is carried out by actuation of the main switch after the apparatus is left under the high temperature and high humidity conditions, the photosensitive drum 8 is rotated idly (rotation before start of the latent image formation) prior to the charging operation for the photosensitive drum 8 for the image formation by the charging blade 6. While the photosensitive drum 8 is rotated idly, the charging blade 6 is supplied with a peak-to-peak voltage which is higher than the normal level.

When the AC voltage applied to the charging blade 6 is normally 2.0 Vpp, the AC voltage of 2.4 kVpp is applied in the initial stage for a predetermined period. The application of this voltage continues until a predetermined period elapses, and thereafter, the charging member is supplied with 2.0 kVpp. Table 3 shows the evaluation of the image quality depending on the AC voltage level and the voltage application period to the charging member.

The speed of the idle rotation of the photosensitive drum 8 may be made lower than that during the image forming operation, or it may be stopped. With this state, the higher AC voltage is applied. By doing so, the black stripe removing effect appears more quickly than when the speed of the drum idle rotation is the same as the normal level, and therefore, the above-described predetermined period is shorter. The evaluation of the image quality is given in Table 4.

TABLE 3

| AC voltage | Initial voltage (sec) | | |
|---|---|---|---|
| (kVpp) | 10 | 20 | 30 |
| 2.0 | NG | F | F |
| 2.2 | F | F–G | F–G |
| 2.4 | G | G | G |

TABLE 4

| AC voltage | | Duration (sec) | | |
|---|---|---|---|---|
| (kVpp) | | 10 | 20 | 30 |
| Idle rot. | 2.2 | F | F–G | F–G |
| Idle rot. | 2.4 | G | G | G |
| At rest | 2.2 | F–G | G | G |
| At rest | 2.4 | G | G | G |

Thus, the image defect in the form of stripes can be avoided by making the applied charging member higher from the start of the voltage application to the charging member up to elapse of the predetermined period than after elapse of the predetermined time. The voltage application can be reduced during the normal state other than the initial stage, the deterioration of the photosensitive member attributable to the charging action can be suppressed.

EMBODIMENT 3

In Embodiment 1, the charging blade 6 is supplied with an AC voltage which is higher than the normal level is applied during the initial image forming operation, so that satisfactory images can be provided. Until 3–4 image forming operations, the higher AC voltage than the normal has to be used to provide satisfactory images. In this embodiment, the higher AC voltage continues to be applied to the charging member also for the area of the photosensitive member which correspond to sheet interval between a certain image forming operation and the next image forming operation when the image forming operations are continuously carried (the area has approx. 5 cm). Accordingly, the normal voltage level can be used with a smaller number of image forming operations than in Embodiment 1.

In this embodiment, the voltage applied to the charging member is higher until 2–3 images are formed after actuation of the main switch of the apparatus (initial stage) than in the subsequent image forming operations. Additionally, during the initial stage, the voltage applied to the charging member is also higher than in the normal image forming operation, for the non-image area between an image area and the next image area.

According to this embodiment, the proper images can be produced while the time period of the initial stage can be shortened.

EMBODIMENT 4

Figure 3:
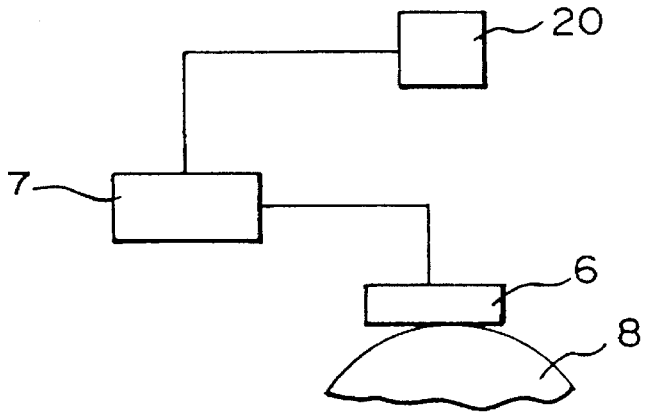
FIG. 3 illustrates an apparatus according to a fourth embodiment of the present invention.

According to the above-described Embodiments 1–3, the problem of the black stripe under the high humidity and high temperature conditions, immediately after the actuation of the main switch of the apparatus, can be avoided. However, slight black stripe can remain in some cases. In this embodiment, therefore, the apparatus has a black stripe removing mode. If the black stripe is produced in the initial image formation, the user can depress the mode key (FIG. 3) 20, by which the higher alternating voltage is applied to the charging blade 6 for a predetermined period. By doing so, the black stripe can be avoided. Thus, by the mode selecting key 20, the level of the peak-to-peak voltage of the AC voltage applied to the charging member can be controlled, for example, when the mode key is depressed, it is 2.4 kVpp, and if it is off-stage, 2.0 kVpp.

In Embodiments 1–4, the charging blade 6 is used as the contact charging member. However, this invention is applicable to a charging roller in place of the charging blade, with the same advantageous effects. In addition, another contact charging member is usable. However, the contamination of the charging surface of the charging member tends to occur in the case of fixed member such as blade, and therefore, the present invention is more effective in the case of the charging blade or the like.

In the foregoing embodiments, the hither voltage is used in the initial stage after the actuation of the main switch of the apparatus. However, the voltage applied to the charging member in the initial stage may be the same as in the normal state, if the temperature of the fixing roller of the fixing device 14 is higher than a predetermined temperature (standby temperature), even after the actuation of the main switch. This is because if the temperature of the fixing roller is higher than the predetermined temperature, the time period in which the apparatus is left with the main switch being in off-state, is so small that any particular initial stage voltage setting is not required.

When the comparison is made between a charging roller and a charging blade, the charging roller is constituted by electroconductive material, and the conductive material has to be uniformly applied on the outer surface of the core metal (power supply member). The manufacturing steps for the charging roller 1 includes machining of the core metal, bonding between the core metal and the electroconductive member, abrasion for the diameter and the surface property. Additionally, number of parts is large, and the manufacturing cost of the charging roller is higher. On the contrary, the charging blade has very simple structure, and therefore, the manufacturing cost is low. Thus, from the standpoint of the manufacturing cost, the charging blade prefers to the charging roller.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a member to be charged;

charging member for charging said member to be charged, said charging member is being contactable to said member to be charged and being supplied with a voltage;

wherein the voltage applied to said charging member for image formation contains an oscillation component, and a peak-to-peak voltage of the oscillation component in a first period for formation of a predetermined number of initial images, and is higher than in a second period after the predetermined number of image formations.

2. An apparatus according to claim 1, wherein said peak-to-peak voltage in the first period is not less than 1.1 times that in the second period.

3. An apparatus according to claim 1, wherein said peak-to-peak voltage in the first period is not less than 1.2 times that in the second period.

4. An apparatus according to claim 1 wherein said member to be charged is an image bearing member, and the voltage applied to the charging member in the first period for a non-image area between an image area and a next image area on said image bearing member, is higher than the voltage applied to the charging member for the image formation in the second period.

5. An apparatus according to claim 1, wherein said member to be charged is an image bearing member, and the oscillating component applied to the charging member in the first period for a non-image area between an image area and a next image area on said image bearing member, is larger than an oscillating component applied to the charging member for the image formation in the second period.

6. An apparatus according to claim 1, further comprising manual switching means for switching the voltage applied to the charging member between a first level and a second level which is higher than the first level.

7. An apparatus according to any one of claims 1, 2–6, wherein the first period is from an actuation of a main switch of said apparatus to an end of formations of a predetermined number of images.

8. An apparatus according to any one of claims 1, 2–6, wherein said charging member does not move when said member to be charged moves.

9. An apparatus according to claim 8, wherein said charging member is a blade.

10. An apparatus according to any one of claims 1, 2–6, wherein said member to be charged is an image bearing member.

11. An apparatus according to claim 10, wherein said member to be charged is an electrophotographic photosensitive member.

12. An image forming apparatus comprising:

a member to be charged;

a charging member for charging said member to be charged, said charging member being contactable to said member to be charged and being supplied with a voltage;

wherein the voltage applied to said charging member contains an oscillating component, and a peak-to-peak voltage of the oscillating component, in a first period from start of initial voltage application to said charging member to elapse of a predetermined period, is higher than that in a second period after the elapse of the predetermined period.

13. An apparatus according to claim 12, wherein said peak-to-peak voltage in the first period is not less than 1.1 times that in the second period.

14. An apparatus according to claim 12, wherein said peak-to-peak voltage in the first period is not less than 1.2 times that in the second period.

15. An apparatus according to claim 12, wherein the first period appears before start of image formation, and the image formation starts in the second period.

16. An apparatus according to claim 12, wherein said member to be charged is at rest in the first period, or is moved at a speed lower than in the second period.

17. An apparatus according to claim 12, further comprising manual switching means for switching the voltage applied to the charging member between a first level and a second level which is higher than the first level.

18. An apparatus according to any one of claims 12, 13–17, wherein the first period begins when voltage is applied to said charging member and ends after a predetermined period, which is after actuation of a main switch of said apparatus.

19. An apparatus according to any one of claim 12, wherein said charging member does not move when said member to be charged moves.

20. An apparatus according to claim 20, wherein said charging member is a blade.

21. An apparatus according to any one of claims 12, 13–17, wherein said member to be charged is an image bearing member.

22. An image forming apparatus comprising:

a member to be charged;

charging member for charging said member to be charged, said charging member being contactable to said member to be charged and being supplied with a voltage;

manual switching means for switching the voltage applied to the charging member between a first voltage and a second voltage which is higher than the first voltage.

23. An apparatus according to claim 22, wherein the first and second voltages contain an oscillating component, the first voltage has a first peak-to-peak voltage, and the second voltage has a second peak-to-peak voltage higher than the first peak-to-peak voltage.

24. An apparatus according to claim 23, wherein said second peak-to-peak voltage is not less than 1.1 times the first peak-to-peak voltage.

25. An apparatus according to claim 23, wherein the second peak-to-peak voltage is no less than 1.2 times the first peak-to-peak voltage.

26. An apparatus according to claim 22, wherein said first and second voltage are voltages applied to the charging member for image formation.

27. An apparatus according to any one of claims 22–26, wherein said charging member does not move when said member to be charged moves.

28. An apparatus according to claim 27, wherein said charging member is a blade.

29. An apparatus according to any one of claims 22–26, wherein said member to be charged is an image bearing member.

30. An apparatus according to claim 29, wherein said member to be charged is an electrophotographic photosensitive member.

31. An image forming apparatus comprising:

a member to be charged;

charging member for charging said member to be charged, said charging member is being contactable to said member to be charged and being supplied with a voltage;

wherein the voltage applied to said charging member for image formation contains an oscillating component, and wherein a peak-to-peak voltage of the oscillating component in a first period for formation of a predetermined number of initial images is higher than in a second period after the predetermined number of image formations, and wherein said member to be charged is an image bearing member, and wherein the voltage applied to the charging member in the first period for a non-image area, between an image area and the next image area, on said image bearing member is higher than the voltage applied to the charging member for the image formation in the second period.

32. An apparatus according to claim 31, wherein the first period is from an actuation of a main switch of said apparatus to an end of formations of a predetermined number of images.

33. An apparatus according to claim 31, wherein said charging member does not move when said member to be charged moves.

34. An apparatus according to claim 34, wherein said charging member is a blade.

35. An apparatus according to claim 31, wherein said member to be charged is an image bearing member.

36. An apparatus according to claim 35, wherein said member to be charged is an electrophotographic photosensitive member.

37. An image forming apparatus comprising:

a member to be charged;

a charging member for charging said member to be charged, said charging member being contactable to said member to be charged and being supplied with a voltage;

wherein the voltage applied to said charging member contains an oscillating component, and wherein a peak-to-peak voltage of the oscillating component in a first period from the beginning of initial voltage application to said charging member to the end of a predetermined period is higher than that in a second period after the elapse of the predetermined period, and wherein the first period begins before start of image formation, and the image formation starts in the second period.

38. An apparatus according to claim 37, wherein said member to be charged is at rest in the first period, or is moved at a speed lower than in the second period.

39. An apparatus according to claim 37, wherein the first period is from start of voltage application to said charging member and to elapse of a predetermined period, after actuation of a main switch of said apparatus.

40. An apparatus according to claim 37, wherein said charging member does not move when said member to be charged moves.

41. An apparatus according to claim 40, wherein said charging member is a blade.

42. An apparatus according to claim 37, wherein said member to be charged is an image bearing member.

43. An apparatus according to claim 42, wherein said member to be charged is an electrophotographic photosensitive member.

* * * * *

UNITED STATES PATENT AND TRADEMARK OFFICE

CERTIFICATE OF CORRECTION

PATENT NO. : 5,561,502

DATED : October 1, 1996

INVENTORS : Masahide Hirai, et al.

It is certified that error appears in the above-identified patent and that said Letters Patent is hereby corrected as shown below:

COLUMN 1

Line 13, "mender)" should read --member)--;
Line 23, "place" should read --the place--;
Line 34, "Corresponding" should read --corresponding--; and
Line 56, "remains. These" should read --remains, these--.

COLUMN 2

Line 62, "blade 8" should read --blade 6--.

COLUMN 3

Line 17, "introduced" should read --is introduced--;
Line 20, "material is" should read --material P, is--; and
Line 27, "device" should read --device 12--.

COLUMN 4

Line 27, "the" (second occurrence) should be deleted.

UNITED STATES PATENT AND TRADEMARK OFFICE

CERTIFICATE OF CORRECTION

PATENT NO. : 5,561,502

DATED : October 1, 1996

INVENTORS : Masahide Hirai, et al.

It is certified that error appears in the above-identified patent and that said Letters Patent is hereby corrected as shown below:

COLUMN 5

Line 51, "2.0 $V_{pp}$," should read --2.0 $kV_{pp}$,--.

COLUMN 6

Line 21, "applied" should read --applied voltage to the--;
Line 39, "correspond" should read --corresponds--; and
Line 41, "carried" should read --carried out--.

COLUMN 7

Line 33, "includes" should read --include--;
Line 51, "is" should be deleted; and
Line 59, "and" should be deleted.

COLUMN 8

Line 1, "claim 1" should read --claim 1,--;
Line 18, "claims 1, 2-6," should read --claims 1 to 6--;
Line 22, "claims 1, 2-6," should read --claims 1 to 6--;
Line 27, "claims 1, 2-6," should read --claims 1 to 6--;
Line 63, "claims 12," should read --claims 12 to 17,--; and
Line 64, "13-17" should be deleted.

UNITED STATES PATENT AND TRADEMARK OFFICE

CERTIFICATE OF CORRECTION

PATENT NO. : 5,561,502

DATED : October 1, 1996

INVENTORS : Masahide Hirai, et al.

It is certified that error appears in the above-identified patent and that said Letters Patent is hereby corrected as shown below:

COLUMN 9

Line 1, "claim 12," should read --claims 12 to 17,--;
Line 4, "claim 20," should read --claim 19,--;
Line 6, "claim 12," should read --claims 12 to 17,-;
Line 7, "13-17," should be deleted;
Line 30, "voltage" should read --voltages--; and
Line 46, "is" should be deleted.

COLUMN 10

Line 14, "claim 34," should read --claim 33,--.

Signed and Sealed this

Sixth Day of May, 1997

*Attest:*

*Attesting Officer*

BRUCE LEHMAN

*Commissioner of Patents and Trademarks*